US006409111B1

(12) United States Patent
Kokko

(10) Patent No.: US 6,409,111 B1
(45) Date of Patent: Jun. 25, 2002

(54) APPARATUS FOR REDUCING THE OVERSIZED FRACTION OF CHIPS

(75) Inventor: Pekka Kokko, Hollola (FI)

(73) Assignee: Andritz-Patentverwaltungs-GmbH, Graz (AT)

( * ) Notice: Subject to any disclaimer, the term of this patent is extended or adjusted under 35 U.S.C. 154(b) by 0 days.

(21) Appl. No.: 09/579,603

(22) Filed: May 26, 2000

(30) Foreign Application Priority Data

May 28, 1999 (FI) ..... 991219

(51) Int. Cl.[7] ..... B02C 18/18
(52) U.S. Cl. ..... 241/242
(58) Field of Search ..... 241/92, 243, 242

(56) References Cited

U.S. PATENT DOCUMENTS

| | | | | |
|---|---|---|---|---|
| 4,858,834 A | | 8/1989 | Lanham | |
| 5,209,278 A | * | 5/1993 | Carpenter et al. | 241/92 |
| 5,413,287 A | * | 5/1995 | Telsnig | 241/92 |
| 5,937,923 A | | 8/1999 | Bielagus et al. | |

FOREIGN PATENT DOCUMENTS

| | | |
|---|---|---|
| AT | 385 231 B | 3/1988 |
| AT | 390 455 B | 5/1990 |
| DE | 2147 614 | 3/1972 |
| DE | 38 37 200 C1 | 5/1990 |
| DE | 195 18 609 C1 | 2/1996 |
| DE | 196 19 345 A1 | 11/1997 |
| EP | 0 301 996 | 2/1989 |
| EP | 0 744 257 B1 | 11/1996 |
| FI | 854334 | 5/1987 |
| SE | 345 820 | 12/1972 |
| SE | 393763 B | 5/1977 |
| SE | 45164 C1 | 5/1978 |
| SE | 401903 B | 6/1978 |

OTHER PUBLICATIONS

English abstract of SU 1386460 A.
English abstract of EP03675255, A3, B1.

* cited by examiner

*Primary Examiner*—Mark Rosenbaum
(74) *Attorney, Agent, or Firm*—Alix, Yale & Ristas, LLP

(57) ABSTRACT

An apparatus for reducing the oversized fraction of chips, especially the overthick fraction, which apparatus comprises a rotatingly fitted disc-like rotor part (1) to which is attached a number of chipping blades (2), and a fixed stator part (3) surrounding the rotor part (1), to which stator part is attached a number of counter blades (4), the blades (2) and counter blades (4) being arranged in chipping chambers (5), through which the chips to be reduced are arranged to travel outward with respect to the rotating shaft (6) of the rotor part (1). The counter blades (4) are fitted in a position substantially deviating from the radial direction of the rotating shaft (6), when viewed on the vertical plane with respect to the rotating shaft (6) of the rotor part (1). The chipping chamber (5) is formed by the space between two counter blades (4), the bottom surface (10) of which space is formed by the top surface of the rotor part (1), and the roof surface (11) by the bottom surface of the stator part (3) and counter blade (4) opposite to the top surface of the rotor part (1), whereby, when viewed in the direction of rotation (12) of the rotor part (1), the said roof surface (11) is arranged to converge towards the said bottom surface (10).

19 Claims, 3 Drawing Sheets

APPARATUS FOR REDUCING THE OVERSIZED FRACTION OF CHIPS

FIELD OF THE INVENTION

The invention relates to an apparatus for reducing the oversize fraction of chips, especially the overthick fraction, produced during the process of reducing timber products to chips.

BACKGROUND OF THE INVENTION

From the viewpoint of further processing of the chips, it is important that the size of an individual chip is within a certain range. It is, therefore, necessary to screen the chips and to reduce the size of the chips that have remained oversized during chipping. The oversized fraction of such chips has until now been reduced by using various methods and devices, in which the reduction is carried out by means of a variety of blades or crushers.

However, the reduced chips produced by known solutions do not always fully meet the requirements set for chips because the reduction does not take place in a controlled manner. The blades cut, break or crush oversized chips in random directions, thus reducing the size of some of the chips excessively.

The type of apparatus referred to above is known from the Swedish publication SE 345 820. In this apparatus, the counter blades are arranged essentially in the radial direction. Reducing the size of chips in accordance with this type of solution does not take place in a completely controlled manner either, which means that some of the chips become too small.

SUMMARY OF THE INVENTION

A chip reduction apparatus in accordance with the present invention comprises a rotatingly fitted disc-like rotor part to which are attached a number of chipping blades, and a fixed stator part surrounding the top surface of the rotor part, to which stator part are attached a number of counter blades, the blades and counter blades being arranged in a series of chipping chambers, through which the chips to be reduced travel outwardly with respect to the rotational axis of the rotor part. The counter blades are fitted in a position substantially deviating from the radial direction of the rotating shaft, when viewed on the vertical plane with respect to the rotating shaft of the rotor part, and that the chipping chamber is formed by the space between two counter blades, the bottom surface of which space is formed by the top surface of the rotor part, and the roof surface by the bottom surface of the stator part and counter blade opposite to the top If surface of the rotor part, whereby, when viewed in the direction of rotation of the rotor part, the said roof surface is arranged to converge towards the said bottom surface.

Preferably, each chipping chamber has a height defined by the top surface of the rotor part and the bottom surface of the stator part, a length defined by the distance between two counter blades measured in the direction of rotor rotation and an outer perimeter defined by an annular wall or limiter which projects from the stator part toward the rotor part. The bottom surface of the stator part, which defines the upper limit of the chipping chambers, is configured to converge toward the top surface of the rotor part in the direction of rotation of the rotor part. The bottom surface of the stator part reaches its closest approach to the rotor part at the location of each counter blade, the convergence of the bottom surface of the stator, the counter blade and the rotor top surface forming a chipping point. The counter blades are arranged on the fixed stator part in an angular orientation which deviates substantially from radii of the stator part. The counter blades are angled approximately 70° from a radial orientation and counter to the direction of rotation of the rotor part. The chipping blades are arranged on the rotor part so the radially outer ends of the chipping and counter blades cross first in the direction of rotation and the chipping process occurs in a radially inward direction along the length of the blades. The angular orientations of the chipping and counter blades also produces an advantageous scissors-like angle between the chipping and counter blades.

In an especially preferred embodiment, the apparatus is operated in an orientation such that the shaft driving the rotor part is essentially vertical and the top surface of the rotor part is essentially horizontal. Chips are introduced into the apparatus through a centrally located chip feed opening. Ejector wings, located at the transition of the chip feed opening and the chipping chambers, guide chips into the chipping chambers and toward the counter blades.

Under ordinary circumstances, centrifugal forces exerted by the rapidly rotating rotor part would force the chips to the perimeter of the rotor part. This tendency is countered in two ways by the present invention. First, the orientation of the counter blades opposes the centrifugal forces and spreads the chips evenly over their length. Second, the chipping action, which proceeds along the chipping and counter blades from their radially outer ends toward their radially inner ends serves to oppose the expected radially outward movement of the chips.

An important feature of the invention is that the chips move in a more controlled manner than before on their surfaces parallel with the longitudinal and lateral direction, on the surface of the disc-like rotor part, especially for the reason that, due to the novel alignment of the counter blades, the chips are pressed against the counter blade continuously, and on the other hand, against the bottom and roof surface of the chipping chamber which converges in a wedge-shaped manner in elevation in the direction of rotation of the rotor part of the chipping chamber, which means that when the chips collide with the counter blade, they always settle in the same manner, leaning on their longitudinally and laterally extending surface against the top surface of the rotor part, and are thus chipped into pieces having a lesser thickness. The mutual alignment of the chipping blade and the counter blade produce a suitable scissor angle which further facilitates the implementation of a controlled chipping process.

An object of the present invention is to produce a new and improved chip reduction apparatus which controls the orientation of chips during the reduction process.

Another object of the present invention is to produce a new and improved chip reduction apparatus which reduces the thickness of chips while retaining the lateral and longitudinal dimensions of the chips.

A further object of the present invention is to produce a new and improved chip reduction apparatus which reduces oversize chips in a controlled manner, maximizing the output of chips having specified dimensions and minimizing the output of excessively reduced chips.

These and other objects, features and advantages of the invention will become readily apparent to those skilled in the art upon reading the description of the preferred embodiments, in conjunction with the accompanying drawings.

DETAILED DESCRIPTION OF THE PREFERRED EMBODIMENT

Figure 1:
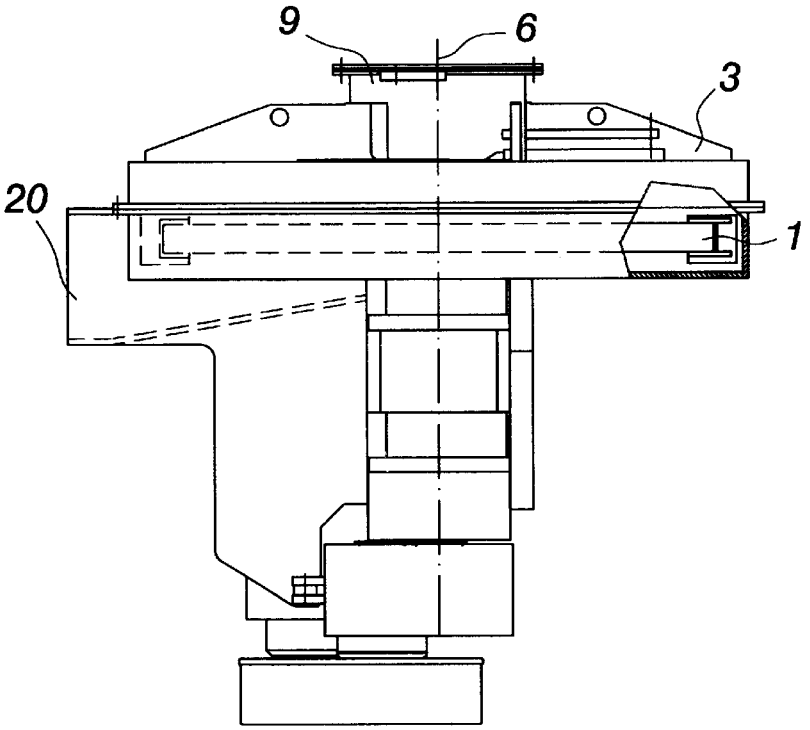
FIG. 1 is a diagrammatic side view of a chip reduction apparatus in accordance with the present invention.
Figure 2:
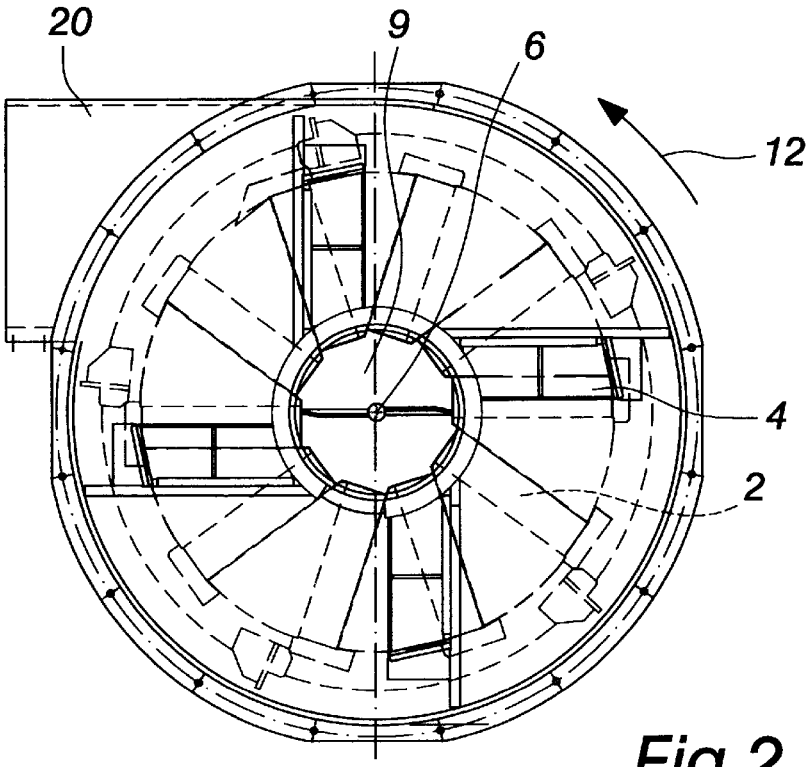
FIG. 2 is a diagrammatic top view of the chip reduction apparatus of FIG. 1.

The apparatus for reducing the oversized fraction of chips, especially the overthick fraction, comprises a rotatingly fitted disc-like rotor part 1 to which are attached a number of chipping blades 2, and a fixed stator part 3 surrounding the rotor part 1, to which stator part are attached a number of counter blades 4. The chipping blades 2 and counter blades 4 are arranged to operate in one or more chipping chambers 5 provided between the rotor part 1 and the stator part 3, through which chambers the chips to be reduced in size are arranged to travel outward with respect to the rotating shaft 6 of the rotor part 1. Chip feed has been arranged to take place from the center, through a feed opening 9 arranged at the rotating shaft 6.

In principle it suffices to use one chipping blade 2 and one counter blade 4, but most preferably there are both several chipping blades 2 and counter blades 4 in the same apparatus. The number of blades 2 and counter blades 4 may differ in the same device. In the example shown in FIG. 3, four counter blades 4 are used, of which, however, only two are shown in the drawing, and correspondingly also only one chipping blade 2 is shown.

The counter blades 4 are fitted in a position substantially deviating from the radial direction of the rotating shaft 6, when viewed on the vertical plane with respect to the rotating shaft 6 of the rotor part 1 in such a way that while the rotor part 1 rotates, the chipping blade 2 is arranged to first meet the radially outer end 7 of the counter blade 4 which is furthest from the rotating shaft 6 of the rotor part 1. The radially inner end 8 of the counter blade 4, which is closest to the rotating shaft 6 of the rotor part 1, is fitted at a distance corresponding approximately to the radius of the chip feed opening 9 from the rotating shaft 5 at the rotor part 1. The chipping blade 2 is arranged at an angle with respect to the counter blade 4, the size of which angle is chosen so that it will not cause the chips to travel substantially in the longitudinal direction of the counter blade 4 due to the effect of the chipping process.

Figure 5:
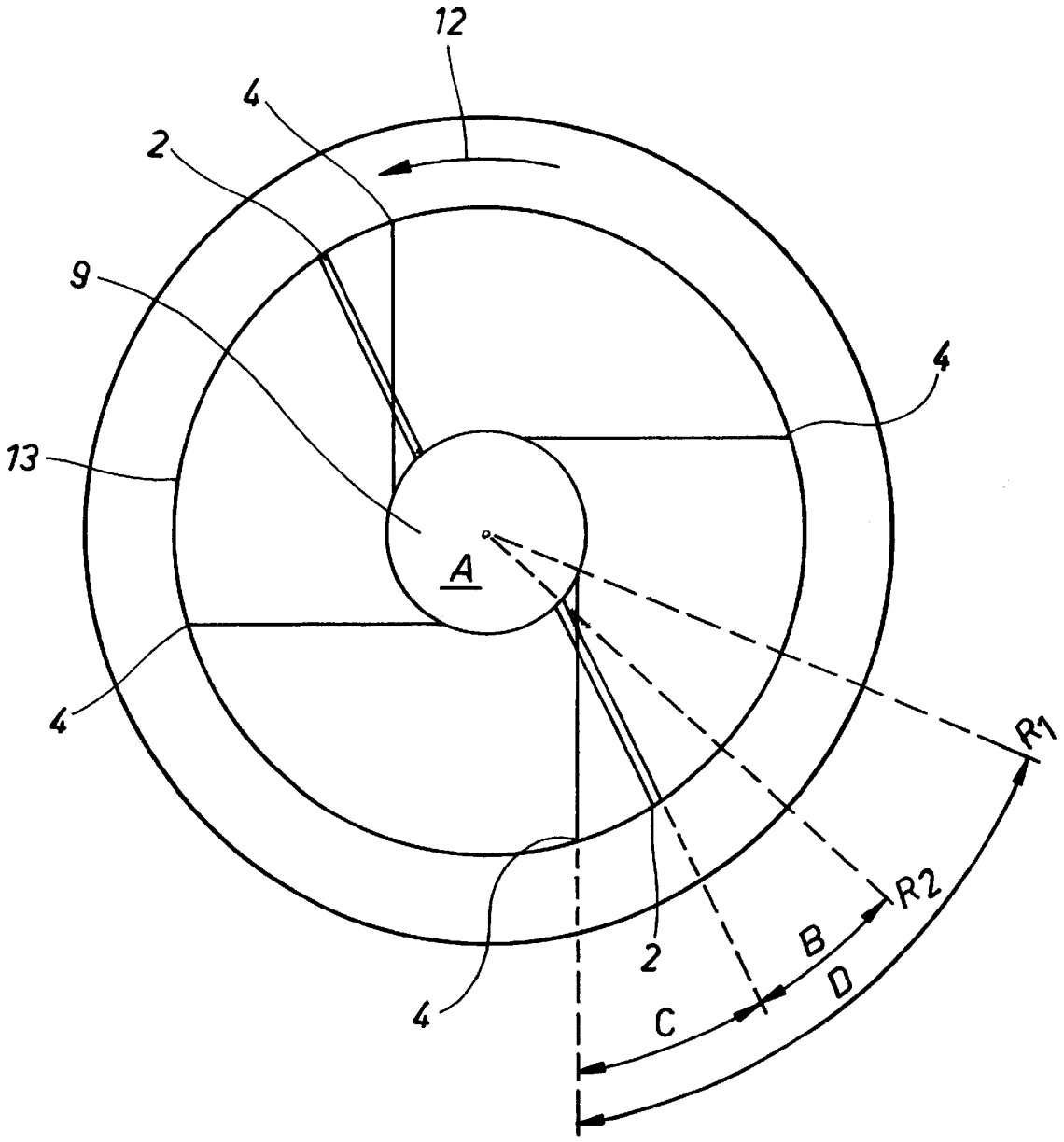
FIG. 5 is a simplified line drawing top view of an alternative embodiment of the chip reduction apparatus in accordance with the present invention.

FIG. 5 illustrates the angular orientation of the chipping blades 2 and the counter blades 4 both to each other and with respect to radii $R_2$ and $R_1$, respectively. Radii $R_1$ and $R_2$ project from the central axis A through the periphery of the apparatus. Counter blade 4 deviates from a radial orientation by an angle D of approximately 48°. It should be noted that the deviation of the counter blades is opposed to the direction of rotation 12 of the rotor part. This angled orientation, relative to the direction of rotation 12 of the rotor part, gathers chips headed for the perimeter of the rotor part and spreads them along the length of the counter blade 4.

Similarly, the chipping blades 2 deviate from a radial orientation by an angle B of approximately 23.5°. The combined angular orientations of the chipping blades 2 and the counter blades 4 have the effect of producing an angled meeting (angle C) between the chipping and counter blades of approximately 9.5° to 27.5°. When the rotor is moving in its direction of rotation 12, the chipping blade and counter blade meet at their respective radially outer ends and the chipping action takes place along the length of the blades in a radially inward direction. This radially inward chipping action further opposes the radially outward tendency of the chips, serving to spread the chips evenly over the length of the counter blades 4.

Figure 3:
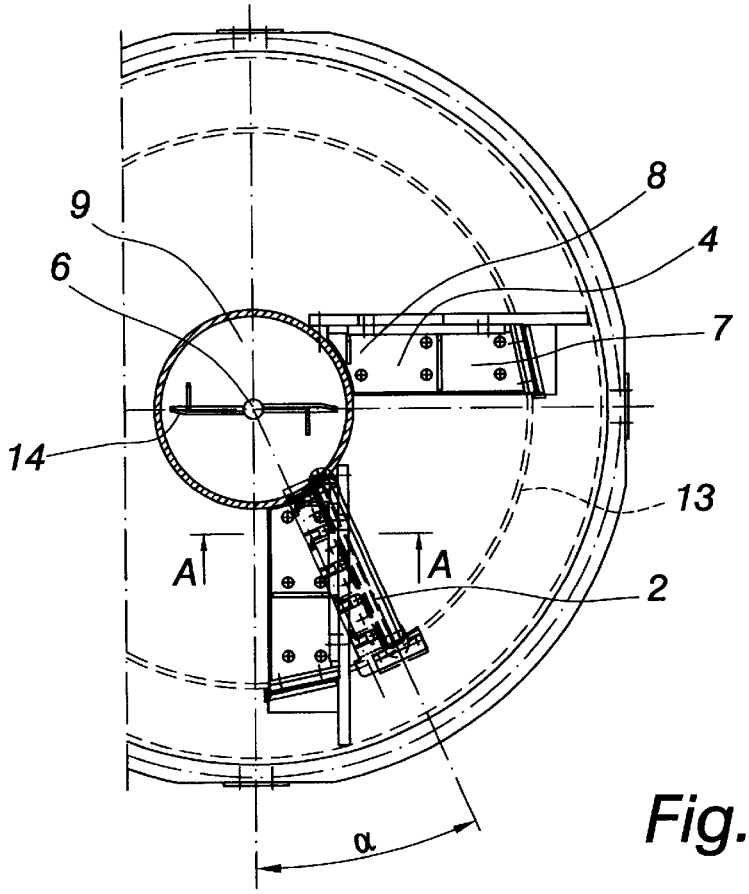
FIG. 3 is an enlarged, partial view of FIG. 2, with parts removed for clarity.
Figure 4:
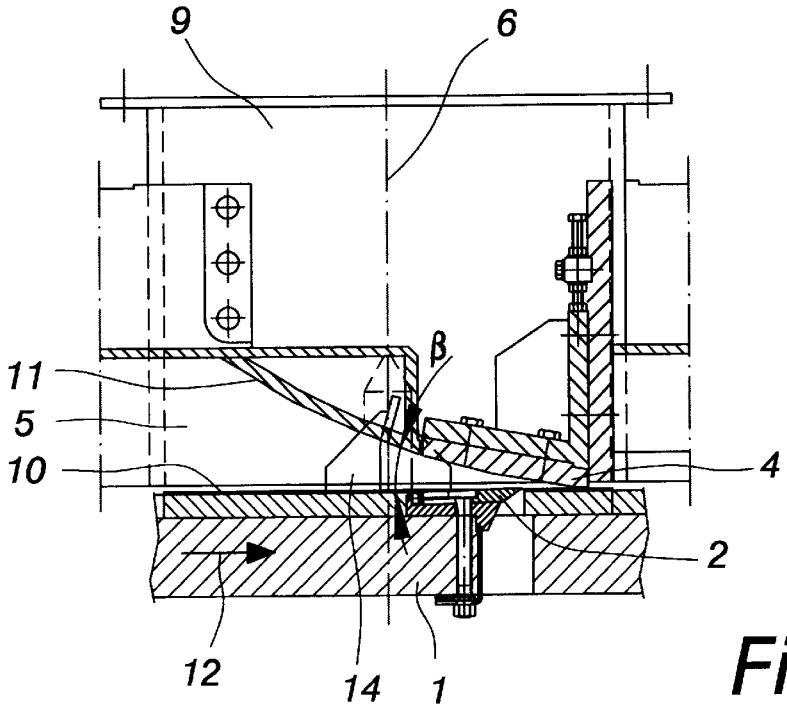
FIG. 4 is a partial sectional view taken along line A—A of FIG. 3.

With reference to FIGS. 3 and 4, the length of each chipping chamber 5 in the direction of rotation 12 is defined by the space between two counter blades 4. The number of chipping chambers 5 thus equals the number of counter blades 4. The bottom surface 10 of the chipping chamber 5 is defined by the top surface of the rotor part 1. The upper limit 1 of the chipping chamber is defined by the bottom surface of the stator part 3 and the counter blade 4 opposite to the top surface of the rotor part 1. When viewed in the direction of rotation 12 of the rotor part 1, the said upper limit, or roof surface 11 is arranged to converge towards the bottom surface 10. In the immediate vicinity of the counter blade 4, the bottom surface of the stator part 3 converges towards the top surface 10 of the rotor part 1 in the direction of rotation 12 of the rotor part 1 at an acute angle β, which is less than 25°.

On the side wall of the tubular part forming the chip feed opening 9, at each of the chipping chambers 5, are arranged wedge-shaped openings corresponding to the shape of the chipping chamber 5, as seen best in FIG. 4. At the chip feed point 9 in the rotor part 1 are arranged ejector wings 14 or the like for feeding the chips into the chipping chambers 5 and towards the counter blades 4.

When viewed in the direction of rotation 12 of the rotor part 1, at least immediately at the front of the counter blade 4 is a limiter 13 which, in the example shown in FIG. 3, is formed by an annular wall attached to the stator part 3, the said wall being arranged to stop the chips at a certain distance from the rotating shaft 6 of the rotor part 1 in order to guide the chips to the counter blade 4. Unobstructed movement of the chips away from the rotating shaft 6 of the rotor part 1 is ensured at least immediately at the back of the counter blade 4, most preferably by providing an opening in the limiter 13, the height of the opening being preferably selected so that chips which are thinner than the desired maximum thickness of the chips can pass through the opening.

The chips are passed through the feed opening 9 at the limited capacity inherent of the apparatus into the chipping chambers 5. Due to the alignment of the counter blades 4 deviating from the radial direction, the chips are spread over the total length of the counter blade 4. Due to the shape of the chipping chamber 5, which converges in a wedge-shaped manner towards the counter blade 4, when the chips collide with the counter blade 4, they always settle in the same manner, leaning on their longitudinally and laterally extending surfaces against the top surface of the rotor part 1, and are thus chipped, as a rule, always to a lesser thickness, whereby their other dimensions remain unchanged.

Overthick chips do not fit through the gap between the counter blade 4 and the top surface 10 of the rotor part 1 so as to leave the chipping chamber 5, but will stop there until the chipping blade 2 chips a piece from the bottom part of the chip essentially parallel with its longitudinal and lateral directions, which piece then leaves through the blade opening at the front of the blade 2, from where it is guided by means of members known as such, out of the apparatus through the outlet 20.

When the thickness of a chip falls short of the desired measurement, the chip can pass through the opening between the counter blade 4 and the top surface 10 of the rotor part 1. The chip will then enter the next chipping chamber 5 from where it can, however, immediately leave in the radial direction of the rotor part 1, through the opening arranged in the limiter 13 forming the outer circumference of the chipping chamber 5.

What is claimed is:

1. An apparatus for reducing the oversized fraction of chips, which apparatus comprises a rotatingly fitted disc-like rotor part (1) to which are attached a number of chipping blades (2), and a fixed stator part (3) surrounding the rotor part (1), to which stator part are attached a number of counter blades (4), the blades (2) and counter blades (4) being arranged in a chipping chamber (5), through which the chips to be reduced are arranged to travel outward with respect to the rotating shaft (6) of the rotor part (1), characterized in that the counter blades (4) are fitted in a position substantially deviating from the radial direction of the rotating shaft (6), when viewed on the vertical plane with respect to the rotating shaft (6) of the rotor part (1), and that the chipping chamber (5) is formed by the space between two counter blades (4), the bottom surface (10) of which space is formed by the top surface of the rotor part (1), and the roof surface (11) by the bottom surface of the stator part (3) and counter blade (4) opposite to the top surface of the rotor part (1), whereby, when viewed in the direction of rotation (12) of the rotor part (1), the said roof surface (11) is arranged to converge towards the said bottom surface (10).

2. The apparatus of claim 1, characterized in that at least over some part at the back of the counter blade (4), the unobstructed movement of the chips away from the rotating shaft (6) of the rotor part (1) to outside the chipping area is ensured.

3. The apparatus of claim 1, characterized in that one or more ejector wings (14) are arranged at the chip feed point (9) in the rotor part (1) for forcing the chips into the chipping area.

4. The apparatus of claim 1, characterized in that when viewed in the direction of rotation (12) of the rotor part (1), at least immediately at the front of the counter blade (4) is a limiter (13) which is arranged to prevent the chips from moving beyond a certain distance from the rotating shaft (6) of the rotor part (1).

5. The apparatus of claim 1, characterized in that when viewed in the direction of rotation (12) of the rotor part (1), at least immediately at the front of the counter blade (4) is a limiter (13) which is arranged to prevent the chips from moving beyond a certain distance from the rotating shaft (6) of the rotor part (1), and that at the same time, at least over some part at the back of the counter blade (4) the unobstructed movement of the chips away from the rotating shaft (6) of the rotor part (1) to outside the chipping area is ensured.

6. The apparatus of claim 1, characterized in that while the rotor part (1) rotates, the chipping blade (2) is arranged to first meet the end (7) of the counter blade (4) which is further away from the rotating shaft (6) of the rotor part (1).

7. The apparatus of claim 1, characterized in that the end (8) of the counter blade (4) which is closest to the rotating shaft (6) of the rotor part (1) is fitted at a distance corresponding approximately to the radius of the chip feed opening (9) from the rotating shaft (6) of the rotor part (1).

8. The apparatus of claim 1, characterized in that the chipping blade (2) is arranged at an angle with respect to the counter blade (4), the size of the angle being selected so that it will not cause the chips to travel essentially in the longitudinal direction of the counter blade (4) due to the effect of the chipping process.

9. The apparatus of claim 1, characterized in that in the immediate vicinity of the chipping point, the bottom surface of the counter blade (4) emerges on the top surface (10) of the rotor part (1) in the direction of rotation (12) of the rotor part (1) at an angle β, which is less than 25°.

10. An apparatus for reducing chips to a desired thickness, said apparatus having a central axis, said apparatus comprising:

a disk-like rotor part having a top surface including a plurality of chipping blades, said rotor part mounted for rotation in a direction about said axis, said chipping blades having a length defined a radially inner end and a radially outer end relative to said axis, a fixed stator part, having a bottom surface including a plurality of counter blades, each said counter blade having a length defined by a radially inner end and a radially outer end relative to said axis, and a chipping chamber having a length in the direction of rotation which is defined by first and second of said counter blades, said chipping chamber having a height defined by the distance between said top surface and said bottom surface, said bottom surface convering toward said top surface in the direction of rotation, wherein said counter blades are fitted to said stator part, each said counter blade arranged so that the angular orientation of each said counter blade substantially deviates from a radius perpendicular to said axis, said deviation being counter to the direction of rotation.

11. The apparatus of claim 10, wherein said apparatus includes a limiter, said limiter comprising an annular wall attached to said stator part and projecting toward said rotor part forming a radially outer boundary to said chipping chambers, said limiter is arranged to retain the chips in said chipping chambers, said limiter provided with at least one opening sized to permit chips of the desired thickness to exit said chipping chamber in a radially outward direction.

12. The apparatus of claim 10, wherein said apparatus includes a chip feed point located immediately surrounding said central axis, said chip feed point comprising a chip conduit and wedge-shaped ejector wings for guiding the chips into the chipping chambers and toward the counter blades.

13. The apparatus of claim 10, wherein said chipping blades are arranged whereby rotation of said rotor part in the direction of rotation causes the radially outer arid of each said chipping blade to first is meet the radially outer end of said counter blade and the length of said chipper blade to cross the length of said counter blade from the radially outer end of said counter blade to the radially inner end of said counter blade.

14. The apparatus of claim 10, wherein said bottom surface adjacent to and along the length of said counter blade converges toward said top surface at an angle of less than 25°.

15. The apparatus of claim 12, wherein the radially inner end of each said counter blade is fixed to said stator part at a distance from said axis corresponding approximately to the radius of the chip conduit.

16. The apparatus of claim 10, wherein said chipping blades are arranged to cross said counter blades at an angle C between 9° and 27°, said angle selected to resist a radially outward movement of the chips caused by rotation of said rotor part.

17. The apparatus of claim 10, wherein the angular orientation of each said counter blade deviates from a radius of said stator part by an angle D between 4° and 60°.

18. The apparatus of claim 10, wherein the angular orientation of each said counter blade deviates from a radius of said stator part by an angle D of approximately 48°.

19. The apparatus of claim 10, wherein said chipping blades deviate from a radial orientation by an angle B of approximately 23.5°.

* * * * *

UNITED STATES PATENT AND TRADEMARK OFFICE

CERTIFICATE OF CORRECTION

PATENT NO. : 6,409,111 B1
DATED : June 25, 2002
INVENTOR(S) : Kokko

It is certified that error appears in the above-identified patent and that said Letters Patent is hereby corrected as shown below:

Column 6,
Line 38, after "outer" delete "arid" and insert -- end --.
Line 39, after "first" delete "is".

Signed and Sealed this

Eighteenth Day of February, 2003

JAMES E. ROGAN
*Director of the United States Patent and Trademark Office*